United States Patent [19]

McLaughlin

[11] 3,963,629

[45] June 15, 1976

[54] FABRIC SOFTENER COMPOSITION FOR USE IN A CLOTHES DRYER AND METHOD

[75] Inventor: James Hugh McLaughlin, Chatham, Mass.

[73] Assignee: Center for New Product Development, New York, N.Y.

[22] Filed: Dec. 6, 1973

[21] Appl. No.: 422,193

Related U.S. Application Data

[62] Division of Ser. No. 164,835, July 21, 1971, Pat. No. 3,806,359.

[52] U.S. Cl. ..... 252/8.8; 252/8.6; 252/547; 427/242; 428/279

[51] Int. Cl.[2] ..... D06M 13/46

[58] Field of Search ..... 252/8.8, 8.6; 117/139.5 A; 427/242; 428/279

[56] References Cited

UNITED STATES PATENTS

| | | | |
|---|---|---|---|
| 3,630,949 | 12/1971 | Brux et al. | 252/305 |
| 3,650,816 | 3/1972 | Rudy et al. | 117/109 |
| 3,806,359 | 7/1971 | McLaughlin | 117/139.5 CQ |
| 3,822,145 | 11/1971 | Liebowitz et al. | 117/139.5 A |

FOREIGN PATENTS OR APPLICATIONS

| | | | |
|---|---|---|---|
| 1,313,697 | 4/1973 | United Kingdom | 117/109 |

OTHER PUBLICATIONS

Chem. Absts., vol. 77: 166095z, "Softening of Textiles," Furgal.

*Primary Examiner*—Donald E. Czaja
*Assistant Examiner*—Edward Woodberry

[57] ABSTRACT

A method of treating clothing articles with a fabric softener in a clothes dryer is disclosed, which comprises contacting the clothing articles with a foam containing said fabric softener. Also, fabric softener-containing compositions are disclosed which provide a stable, substantially form-sustaining, easily distributable foam when dispensed from an aerosol container, said compositions comprising by weight of the total composition (a) from about 1.0 to 30.0 percent of a fabric softener, (b) from about 50.0 to 94.0 percent of a solubilizer, and (c) from about 5.0 to 25.0 percent of a propellant, and wherein the solubilizer includes water in an amount comprising at least 40 percent of the total composition.

5 Claims, No Drawings

FABRIC SOFTENER COMPOSITION FOR USE IN A CLOTHES DRYER AND METHOD

This is a division of application Ser. No. 164,835, now U.S. Pat. No. 3,806,359, filed July 21, 1971.

This invention relates to a method for treating clothing articles with fabric softeners and to compositions therefor. More specifically it relates to a method for treating clothing articles with a fabric softener while in a clothes dryer, i.e., in a tumbling, dry-heat, substantially anhydrous environment, and to aerosol compositions therefor.

BACKGROUND OF THE INVENTION

The use of various fabric softeners in home laundry products has been a common practice for many years. Such products are often of the type particularly suitable for use in washing machines. Only rarely has the deployment of a fabric softener in a composition for use in a clothes dryer been contemplated even though such composition would be very advantageous, since residual detergents and water-rinsing cycles detract from the efficiency of the fabric softeners applied. However, the use of dryer-employed compositions has been discouraged because of the environmental conditions met within the dryer which have substantially prevented, heretofore, the effective distribution of such fabric softeners within the dryer. Obviously, if such fabric softeners cannot be distributed widely and effectively, there can be no effective use of fabric softener-containing compositions in a dryer.

The problem, then, is to provide a method for use in a clothes dryer environment, i.e., a tumbling, a dry-heat, anhydrous environment, which will insure adequate distribution of the fabric softener material to the clothing. A second problem is to provide a composition suitable for use in the dryer environment.

It might be expected that fabric softeners could be easily applied and distributed uniformly to a load of clothing in a clothes dryer because of the heat and mechanical tumbling action of the dryer as well as the occluded water present in the clothing. However, experience has shown that this is not the case. In fact, as stated above, exactly the contrary has proven to be the case.

None of the prior art methods have overcome satisfactorily the aforesaid distribution problems connected with the use of fabric softeners in a clothes dryer.

SUMMARY OF THE INVENTION

It is a primary object of the subject invention to provide a method of treating articles of clothing with a fabric softener material by contacting said clothing with an easily distributable foam containing said fabric softener in a clothes dryer.

A second object of the subject invention is to provide a foamable composition containing a fabric softener for use in a clothes dryer.

Another object of the invention is to provide said foamable composition in a pressurized container.

According to the present invention, a method for treating articles of clothing with a fabric softener comprises contacting at least a portion of said clothing articles with a foam containing said fabric softener, and subjecting said foam-contacted clothing to a tumbling, dry-heat, anhydrous environment.

Also, according to the present invention a composition suitable to be dispensed from an aerosol container for use in a clothes dryer, comprises by weight of the total composition (a) from about 1.0 to 30.0 percent of a fabric softener, (b) from about 50.0 to 94.0 percent of a solubilizer, and (c) from about 5.0 to 25.0 percent of a propellant, wherein the solubilizer includes water in an amount comprising at least 40 percent of the total composition, said (a), (b) and (c) providing a substantially form-sustaining, substantially non-penetrating, surface adherent, easily distributable foam when dispensed from said aerosol container.

DETAILED DESCRIPTION OF THE INVENTION

The foamable composition described broadly above and in all of its embodiments is a discretely balanced mixture of ingredients, each ingredient present contributing to the overall result. In the practice of this invention, the mixture of ingredients is tailored to produce a foam having the desired characteristics of stability, substantial form-sustentation, substantial non-penetrability, surface adherency and distributability. The method of this invention, in its broadest form, comprises contacting at least a portion of the clothing articles in a clothes dryer with a foam containing a fabric softener, and thereafter subjecting the clothing to the normal action of the dryer.

Among the fabric softeners which may be employed in the present invention are the standard cationic fabric softeners, such as dimethyl dihyrogenated tallow ammonium chloride, 1-methyl-1-alkyl-amidoethyl-2-alkylimidozolinium methosulfate, and bis-(2-hydroxyethyl)-alkyl-amine oxide, etc. It is to be understood that any suitable cationic fabric softener may be used in the subject composition. Should non-foamable fabric softeners be employed, any suitable foaming agent can also be employed to impart the necessary foaming action.

The fabric softener component of this invention may be employed in amounts of from about 1.0 to 30.0 percent by weight of the total composition, and preferably between about 3 to 15 percent by weight of the total composition.

The solubilizers employed in the present invention in addition to water include but are not limited to methanol, ethanol, isopropanol, n-propanol, isobutyl alcohol, n-butyl alcohol, secondary-butyl alcohol, amyl alcohol, cyclohexanol, n-hexanol, benzene, toluene, xylene, methyl acetate, ethyl acetate, isobutyl acetate, n-butyl acetate, secondary-butyl acetate, methyl cellosolve acetate, amyl acetate, n-butyl propionate, cellosolve acetate, 2-methoxyethanol, 2-butoxyethanol, n-butyl ether methylene chloride, carbon tetrachloride, perchloroethylene, trichlorobenzene, isopropylbenzene, and mixtures thereof. The solubilizers are employed in amounts ranging from about 50.0 to 94.0 percent by weight of the total composition. However, it has been found that water should be present as at least part of the solubilizer in amounts of at least 40 percent by weight of the total composition. Best results are obtained when water is present in amounts of at least 65% by weight of the total composition. A particularly preferred foam is one having 5% active cationic, 10% propellant, 3.5% alcohol and the balance water. The alcohol content of the solubilizer should not exceed 40% by weight of the total composition.

The propellants in the present invention include any of the well known hydrocarbon or fluorinated hydrocarbon propellants such as trichloromonofluoromethane, dichlorodifluoromethane (Freon 12 made by E. I. duPont de Nemours and Co.), dichloromonofluoromethane, chlorodifluoromethane, methylene chloride, dichlorotetrafluoroethane (Freon 114 made by E. I. duPont de Nemours and Co.), octafluorocyclobutane, chloropentafluoroethane, propane, isobutane, n-butane, vinyl chloride, dimethyl ether, chlorodifluoroethane, ethyl chloride, nitrous oxide, carbon dioxide, nitrogen, and/or mixtures of any or all of the above. Propellants are employed in a range of from about 5.0 to 25.0 percent by weight of the total composition. It should be noted that the propellant additionally can act as a solubilizer and can be used instead of another solubilizer to some extent. A particularly preferred propellant is a mixture of Freon 12 and Freon 114 in amounts of 55–57 and 43–45 percent respectively. Such mixture has been found to have particularly desirable vapor pressure properties.

Also, various inhibitors may be added to the composition depending on the nature of the aerosol container. These inhibitors include sodium nitrite, sodium benzoate and morpholine. These ingredients are generally present in amounts ranging from about 0 to 1.0 percent by weight of the total composition. If desired, additional adjuvants may be included in the fabric softener compositions of this invention. Such adjuvants could include deodorizers, germicides, emollients and the like. Perfumes and colorants are other additives that can be added.

In practice, the compositions of the present invention are conveniently sprayed from an aerosol container. In this regard, any aerosol containers of the type normally used for spraying compositions can be used, such as those of aluminum, tin plate, glass, etc. In like manner, any typical spray actuator can be used.

It should be emphasized that a critical feature of the present invention is the character of the foam which is the vehicle by which the adjuvant material is distributed to the clothing in the dryer. A foam is generally characterized as a coarse dispersion of a gas in a liquid in which the volume of the gas is considerably larger than that of the liquid. The nature of the foam formed is the consequence of many factors, the foaming nature of the adjuvant, or of the foam inducing additive (if the adjuvant is of the type which does not foam of itself), and the critical proportions of the ingredients employed, including solubilizers, propellants, and the like. The desirable foam of this invention is one which is stable, substantially form-sustaining, substantially non-penetrating, surface adherent and easily distributable. Typically, the characteristics of a foam may be assayed on a surface when the foamable solution is sprayed from an aerosol container at a distance of from about 12 to 24 inches from said surface at room temperature.

Stability and form sustentation of foam can be considered together. In effect, foam stability has two aspects, foam drainage and persistance (sustentation). Thus, a foam may drain and become quite thin but may retain its structure. Foams also may collapse as a result of rupture of the foam structure. The foams of the instant invention have relatively slow drainage rates and retain their basic structure.

Foams useful in the present invention are non-penetrating; they tend to stay on the surface to which they are applied. If they penetrate the clothing too quickly, good distribution is impossible.

On the other hand, the foam of the present invention must adhere to the surface with which it comes into contact. As the clothing is tumbled in the dryer, the foam, which was originally sprayed on only the top layer of clothing, comes into contact with other clothing surfaces and a thin layer adheres to these new surfaces.

In general, the qualities of the foam, as defined above, should persist on the clothing surfaces contacted for at least that time required for the physical acts of applying the coating of foam on the clothing surfaces, closing the dryer, turning the dryer on and effectuating the tumbling action therein. While this time period may vary somewhat according to the agility of the user, the manner of emplacement and type of dryer used, and the like, as a practical matter it is felt that the foam qualities outlined above should persist for at least about thirty seconds. The longer it takes for the surface applied foam to become unstable, lose its form, penetrate the clothing, etc. the better will be the resulting distributability within the dryer.

To carry out the method of the present invention, the foamable compositions disclosed above are sprayed onto the top layer of clothing in the dryer. For best results, the stream of foam should be directed onto the clothing from a distance of between 12 and 24 inches therefrom. The foam layer is usually evenly applied over essentially the entire top surface of the clothing load. The tumbling action of the dryer then provides the mechanism by which the remaining clothing comes into contact with the foam which easily adheres to any material contacting it.

This invention is not to be limited to any particular method of preparing the above described aerosol composition. Any conventional means of uniformly mixing the components can be used. However, it is preferred that the mixing of ingredients comprising the foamable composition of this invention be effected at an elevated temperature of the order between 160°F and 212°F.

The ingredients were formulated as indicated in the following examples, where all percentages are by weight of total composition, unless otherwise indicated.

EXAMPLE 1

At a temperature of about 175°–210°F, 43.0 parts water and 10.0 parts of a fabric softener of dimethyl dihydrogenated tallow ammonium chloride were mixed together. The mixture was then allowed to cool to room temperature and 15.0 parts dichloromethane and 7.0 parts isopropyl alcohol were then added. The resultant concentrate was then loaded into a container. After removal of air by evacuation or purging, the valve is crimped and 25.0 parts propellant (Freon 12) was pressure loaded.

The composition was then sprayed on the top layer of a normal clothing load (approximately 8 pounds) in a conventional clothes dryer. The dryer cycle was then run and completed. When the clothing was removed, it was determined that significant softening had occurred.

Additional compositions were formulated as indicated above to yield the compositions indicated in the following Table I, where all percentages are by weight of total composition, unless otherwise indicated.

Example 2 contains bis-(2-hydroxyethyl)-alkyl amine oxide as the fabric softener. All of the other examples contain dimethyl dihydrogenated tallow ammonium chloride. Example 2 contains a 55:45 weight percent mixture of Freon 12-Freon 114 respectively as the propellant. Examples 2–8, 17–23 contain Freon 12 and Examples 9–15 contain Freon 114. Examples 16 contains a 57:43 mixture of Freon 12–114. Examples 19–23 do not come within the scope of this invention but are included for comparative purposes.

TABLE I

| EXAMPLE / INGREDIENTS | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|
| FABRIC SOFTENER | 15 | 10 | 10 | 10 | 10 | 10 | 10 | 6 | 6 | 6 | 6 | 6 | 6 | 6 | 5 | 6 | 10 | 10 | 10 | 10 | 10 | 10 |
| DICHLORO-METHANE | 10 | 15 | — | — | — | — | — | — | — | — | — | — | — | — | — | — | — | 28 | 58 | — | — | — |
| WATER | 45 | 41 | 45 | 40 | 65 | 65 | 75 | 57 | 61 | 63 | 65 | 67 | 69 | 74 | 81.5 | 54 | 50 | 30 | — | — | — | 20 |
| ISOPROPYL ALCOHOL | 9 | 9 | 30 | 35 | 10 | — | — | 22 | 18 | 16 | 14 | 12 | 10 | 5 | 3.5 | 25 | 25 | 7 | 7 | 75 | — | — |
| ETHYL ALCOHOL | — | — | — | — | — | — | — | — | — | — | — | — | — | — | — | — | — | — | — | — | — | 20 |
| PROPELLANT | 21 | 25 | 15 | 15 | 15 | 25 | 15 | 15 | 15 | 15 | 15 | 15 | 15 | 15 | 10 | 15 | 15 | 25 | 25 | 15 | 90 | 50 |

A series of tests was run to determine the distribution of the compositions of the foregoing examples in the dryer. To illustrate such distribution each of the test samples was treated as follows:

The composition to be tested was sprayed in a circle or ring pattern on a piece of cloth which was then subjected to the drying cycle. The degree of ring distortion was thereupon examined and was given a designation according to the degree of distortion effected. This value, i.e., the ring distortion value, is hereinafter referred to as the RDV.

The following designations were employed:

An RDV of 3 indicates the presence of an obvious ring and hence essentially no distribution. An RDV of 2 indicates noticeable distortion of the ring but a definite ring pattern is still obvious, i.e., the degree of distribution therefore was somewhat limited. An RDV of 1 indicates a slight trace of a ring pattern and hence a significant degree of distribution. An RDV of 0 indicates the absence of any ring pattern and hence an almost total degree of distribution.

In the practice of this invention, an RDV of 0 or 1 represents the most desirable degree of distribution within the dryer deemed necessary for a commercially effective product. An RDV of 2 is less desirable but is still within the parameters of the subject invention since it is evidence of some meaningful distribution. An RDV of 3 represents no distribution and hence compositions effecting this result do not come within the context of the subject invention.

Table II contains a list of results of the compositions of Examples 1–23, including a brief statement concerning the nature of the foam when sprayed from an aerosol container at a distance of between 12 and 24 inches and the RDV obtained after foam-contacted clothing articles were subjected to the dryer cycle. All of the compositions of this invention represented by Examples 1–18 produced foams which possessed the qualities desired and which persisted for at least 30 seconds duration. For example, the foam produced by Examples 15 persisted even after several hours duration.

TABLE II

| Example | Nature of Foam | RDV |
|---|---|---|
| 1 | Rigid, stable foam | 1 |
| 2 | Stable foam | |
| 3 | Firm foam | 1 |
| 4 | Firm foam | 1 |
| 5 | Voluminous, firm foam | 1 |
| 6 | Shaving cream type foam | 0 |
| 7 | Voluminous stable foam | 0 |
| 8 | Foam like artifical snow | 1 |
| 9 | Firm foam | 1 |
| 10 | Firm foam | 1 |
| 11 | Firm foam | 1 |
| 12 | Firm foam | 1 |
| 13 | Firm foam | 1 |

TABLE II-continued

| Example | Nature of Foam | RDV |
|---|---|---|
| 14 | Firm foam | 1 |
| 15 | Firm low altitude foam | 1 |
| 16 | Firm foam | 0 |
| 17 | Low volume foam | 2 |
| 18 | High altitude foam | 2 |
| 19 | Creamy layer; fast breaking blisters | 3 |
| 20 | No foam; just wet spray | 3 |
| 21 | No foam; wet penetrating spray | 3 |
| 22 | Useless composition; clogged valve | not ascertainable |
| 23 | No foam; penetrating spray | 3 |

Although the present invention has been described with reference to particular embodiments and examples, it will be apparent to those skilled in the art that variations and modifications of this invention can be made.

What I claim as new and desire to secure by letters Patent of the United States is:

1. A pressurized, self-propellant composition suitable to be dispensed from an aerosol container for use in a clothes dryer comprising, by weight of the total composition (a) from about 1.0 to 30.0 percent of a fabric softener, (b) from about 50.0 to 94.0 percent of a solubilizer, and (c) from about 5.0 to 25.0 percent of a propellant, and wherein the solubilizer includes water in an amount comprising at least 40.0 percent of the total composition, said (a), (b) and (c) providing a stable, substantially form-sustaining, substantially non-penetrating, surface adherent, easily distributable foam when dispensed from said aerosol container.

2. The composition of claim 1 wherein (a) comprises 3.0 to 15.0 percent fabric softener, (b) comprises 65.0 to 90.0 percent solubilizer and the balance of the composition is propellant.

3. The composition of claim 1, wherein the solubilizer includes water in an amount comprising at least 65.0 percent of the total composition and the propellant is a member selected from the group consisting of dichlorofluoromethane and dichlorotetrafluoroethane and mixtures thereof.

4. The composition of claim 1, wherein said foam is stable, substantially form-sustaining, substantially non-penetrating and surface adherent for at least about thirty seconds.

5. The composition of claim 1, comprising 5.0 percent of a fabric softener, 81.5 percent water, 3.5 percent isopropyl alcohol and the balance a 57:43 mixture of dichlorodifluoromethane and dichlorotetrafluoroethane.

* * * * *